US009283466B2

(12) United States Patent
Kreger et al.

(10) Patent No.: US 9,283,466 B2
(45) Date of Patent: Mar. 15, 2016

(54) LACROSSE HEAD POCKET RETAINER

(76) Inventors: Colbertson Nordstrom Kreger, Blue Ash, OH (US); Lynn Elizabeth Nordstrom, Blue Ash, OH (US); Verne Edward Kreger, Jr., Blue Ash, OH (US)

( * ) Notice: Subject to any disclaimer, the term of this patent is extended or adjusted under 35 U.S.C. 154(b) by 659 days.

(21) Appl. No.: 13/371,491

(22) Filed: Feb. 13, 2012

(65) Prior Publication Data

US 2012/0205268 A1 Aug. 16, 2012

Related U.S. Application Data

(60) Provisional application No. 61/463,189, filed on Feb. 14, 2011.

(51) Int. Cl.
*B65D 85/20* (2006.01)
*A63B 71/00* (2006.01)

(52) U.S. Cl.
CPC ..... *A63B 71/0045* (2013.01); *A63B 59/20* (2015.10); *A63B 2225/62* (2013.01)

(58) Field of Classification Search
CPC ..... A63B 59/02; A63B 71/0045; A63B 2225/62; A63B 59/20
USPC ..... 206/315.1, 315.9, 579; D21/724, 754; 150/154, 163; 473/446, 513
See application file for complete search history.

(56) References Cited

U.S. PATENT DOCUMENTS

| | | | | |
|---|---|---|---|---|
| 1,664,476 | A * | 4/1928 | Geib | 206/314 |
| 5,425,541 | A * | 6/1995 | Ambros | 473/513 |
| 5,865,013 | A * | 2/1999 | Jackson | 206/8 |
| 7,244,200 | B2 * | 7/2007 | Goldberg | 473/513 |
| 7,338,396 | B2 * | 3/2008 | Gait | 473/513 |
| 7,445,571 | B2 * | 11/2008 | Winningham | 473/513 |
| D595,377 | S * | 6/2009 | Fusco | D21/754 |
| 7,972,228 | B1 * | 7/2011 | Dikmanis et al. | 473/513 |
| 2006/0060484 | A1 * | 3/2006 | Greeley | 206/315.1 |
| 2008/0058129 | A1 * | 3/2008 | Herman | 473/446 |
| 2011/0073226 | A1 * | 3/2011 | Cusa | 150/154 |

* cited by examiner

*Primary Examiner* — Luan K Bui

(57) ABSTRACT

The present invention provides a cover for use with a lacrosse stick that specifically interacts with the net of the lacrosse head to protect the net and the pocket from the environment and selectively maintain a certain shape or contour of the pocket. The pocket retainer is a component that may be selectively positioned within the cover and thereby retains the contour of the net particular to the lacrosse player.

7 Claims, 6 Drawing Sheets

LACROSSE HEAD POCKET RETAINER

CROSS REFERENCE TO RELATED APPLICATIONS

This patent application claims the benefit of U.S. provisional patent application Ser. No. 61/463,189, filed on Feb. 14, 2011, the contents of which are incorporated by reference herein.

STATEMENT REGARDING FEDERALLY SPONSORED RESEARCH OR DEVELOPMENT

Not Applicable.

FIELD OF THE INVENTION

The present invention relates in general to lacrosse equipment and, more particularly, to a lacrosse head cover for protecting the head and maintaining the integrity of the lacrosse head pocket.

BACKGROUND OF THE INVENTION

The lacrosse head includes a frame and a netting that forms a pocket. The frame has a front open, or upper side, for catching and discharging a lacrosse ball and a lower or back side to which the net attaches. The pocket is formed to hold the ball and is used to impart the force upon the ball in order to shoot or pass the ball. A lacrosse head frame generally has a throat section that includes a ball stop for impacting a ball and a socket for receiving a handle or shaft. A pair of sidewalls is attached to the throat section and are joined distal from the throat section by a lip or scoop section.

Men's lacrosse stick netting may be strung with leathers and nylon strings or mesh to form a pocket. Traditionally, a net for a lacrosse head is hand assembled using two or more cross members, or strings, with two or more longitudinal members, or runners. The runners and strings work together to form a pocket and are secured to the frame of the head using a combination of the runners, the cross pieces, and ties that attach to the cross pieces and the frame of the lacrosse head. Additionally, a lacrosse pocket can include other lateral members spanning the distance between the sides of the lacrosse head. Such lateral members, or strings, are referred to as shooting strings, "V" strings or accuracy strings. Such additional strings are used to adjust the depth and tension within the pocket and allow a particular player to customize the lacrosse head pocket to a preferred shooting style and technique.

Another type of net and pocket is formed from a pre-made mesh. Machine woven nylon mesh is pre-manufactured and later attached to the sidewalls, scoop and inside throat areas. The mesh consists of a polyester or nylon material woven together to create a diamond mesh (much like a mesh gym bag). The mesh material is machine made and is the integral body of the pocket. The mesh usually has diamond-shaped holes separating the string-like portions. The mesh is tied to the lower side of the head using separate strings. Shooting strings also attach to the mesh and lateral side walls to adjust the depth and tension of the pocket.

In types of net, the stringing or mesh form a pocket, which is flexible and provides enough material to give the pocket depth beyond the frame to catch, cradle and maneuver a lacrosse ball. A woman's stick head must be strung in the traditional manner, with a pocket formed by a grid of leather strings (no mesh is permitted). The net is attached to the frame via strings weaved through the net and inserted into openings within the frame. Further, the pocket on a woman's stick is much less pronounced than a pocket on a men's stick.

Although the net is flexible, it is preferred to have the net form a particular shape that is optimal for maneuvering the lacrosse ball. The optimal position for a net and pocket often varies from player to player and the particular position played by the player. For example, attackmen and offense midfielders may prefer to have to pocket closer to the shooting strings for a quick release, such as a pass or a shot on goal. Defensemen, on the other hand, may want to have the pocket more proximal to the shooting strings or even close to the throat or proximal end of the head in order to maintain the ball in the pocket. In most cases, the location of the pocket is determined by the stringing technique for attaching the strings or mesh to the frame, as is well known to those skilled in the art.

Since lacrosse is a game that is frequently played outdoors, in all weather conditions, the net will frequently get wet. When wet, the pocket loses its desired shape, and the passing and shooting accuracy of the player is severely hampered. In addition, the pocket loses its desired shape when not in use for an extended period of time, for example, stored in the garage during off season. Therefore, there is a need for a head protector to aid in protecting the head from the weather and also to form and maintain a desired shape of the pocket.

BRIEF DESCRIPTION OF THE FIGURES

The novel features of the invention are set forth with particularity in the appended claims. The invention itself, however, both as to organization and methods of operation, may best be understood by reference to the following description, taken in conjunction with the accompanying drawings in which:

DETAILED DESCRIPTION OF THE INVENTION

Before explaining the present invention in detail, it should be noted that the invention is not limited in its application or use to the details of construction and arrangement of parts illustrated in the accompanying drawings and description. The illustrative embodiments of the invention may be implemented or incorporated in other embodiments, variations and modifications, and may be practiced or carried out in various ways. Further, unless otherwise indicated, the terms and expressions employed herein have been chosen for the purpose of describing the illustrative embodiments of the present invention for the convenience of the reader and are not for the purpose of limiting the invention.

Further, it is understood that any one or more of the following-described embodiments, expressions of embodiments, examples, etc. can be combined with any one or more of the other following-described embodiments, expressions of embodiments, examples, etc.

Still further, the invention will be described in the context of a men's lacrosse head and stick, but the invention has equal application for a women's lacrosse head and stick with obvious variation as will be apparent to one skilled in the art. Further, the invention will be described in the context of mesh netting, but the invention has equal application to a lacrosse head strung in the traditional manner.

Figure 1:
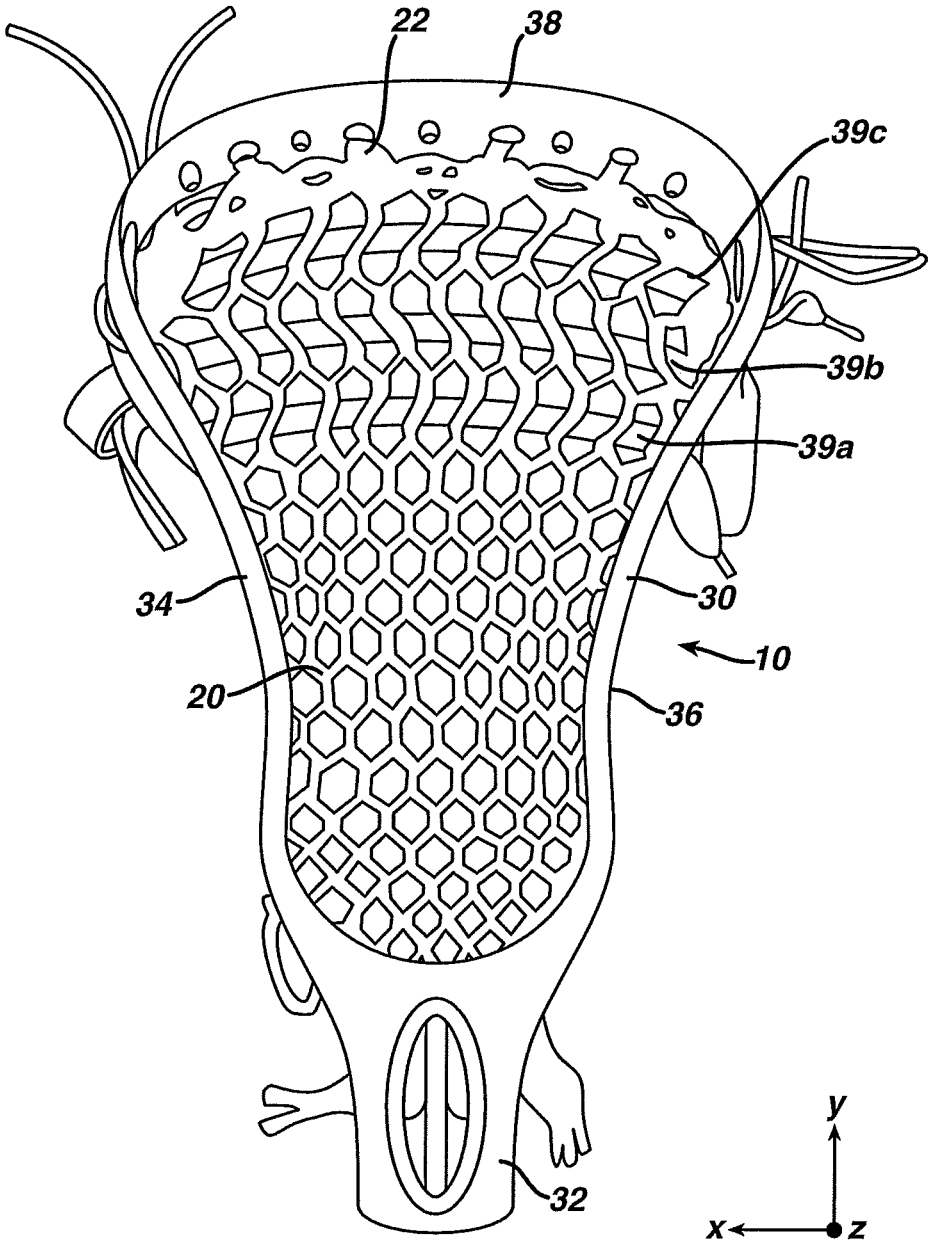
FIG. 1 is a front plan view of a lacrosse head.
Figure 2:
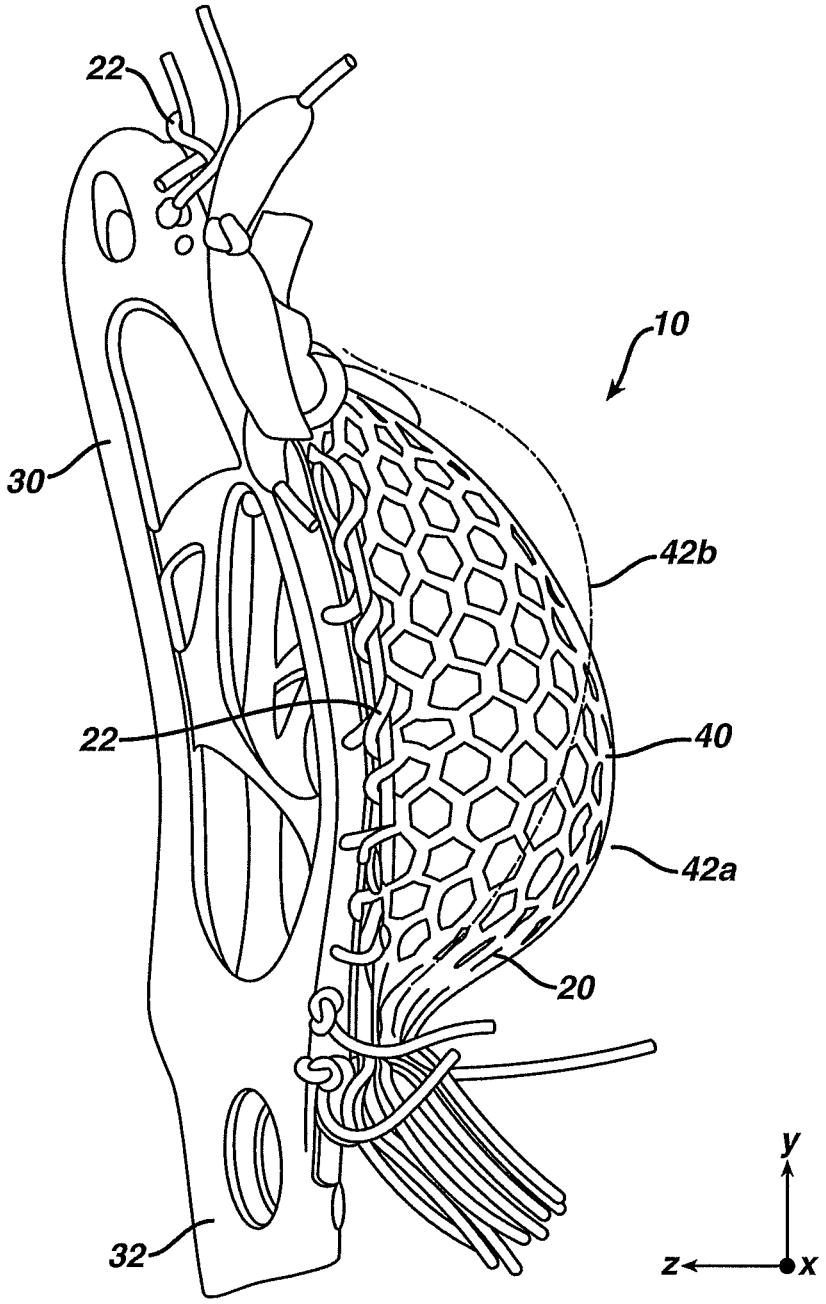
FIG. 2 is a side elevation view of a lacrosse head and net pocket with an alternate position of the pocket shown in phantom.

With reference to FIGS. 1-2, the lacrosse head or frame 10 has an open first face, or upper side for catching and discharging a lacrosse ball and a second face or lower side to which a net 20 is attached for holding the ball and is used to impart the force upon the ball in order to shoot or pass the ball. The frame includes a throat 32, a first sidewall 34, a second sidewall 36 and a lip or scoop 38. A handle (not shown) inserts into the throat 32 and is used by the player to control the lacrosse head. The lacrosse net 20 is flexible and includes enough material to give the net depth beyond the frame to form a pocket 40 to cradle a lacrosse ball. The net 20 attaches to the frame 30 by means of strings 22 that interlace the net 20 to the frame 30 at the sidewalls 34 and 36 and the scoop 38. Shooting strings, "V" strings or accuracy strings 39*a*, 39*b* and 39*c* adjust the depth and tension within the pocket 40. As shown in FIG. 2, the pocket position may be adjusted to be more distal from the throat 32, shown at position 42*b* or more proximal to the throat 32, shown at position 42*a*. The location of the pocket is determined by the means of stringing the net 20 to the frame 30, as is well known to those skilled in the art.

It will be appreciated that the terms "proximal" and "distal" are used herein with reference to a player gripping the handle of the lacrosse stick. Thus, the frame 10 is distal with respect to the more proximal throat 32. It will be further appreciated that, for convenience and clarity, spatial terms such as "vertical", "horizontal", "front", "back", "up" and "down" are used herein with respect to the drawings. However, lacrosse sticks are used in many orientations and positions, and these terms are not intended to be limiting and absolute.

Figure 3:
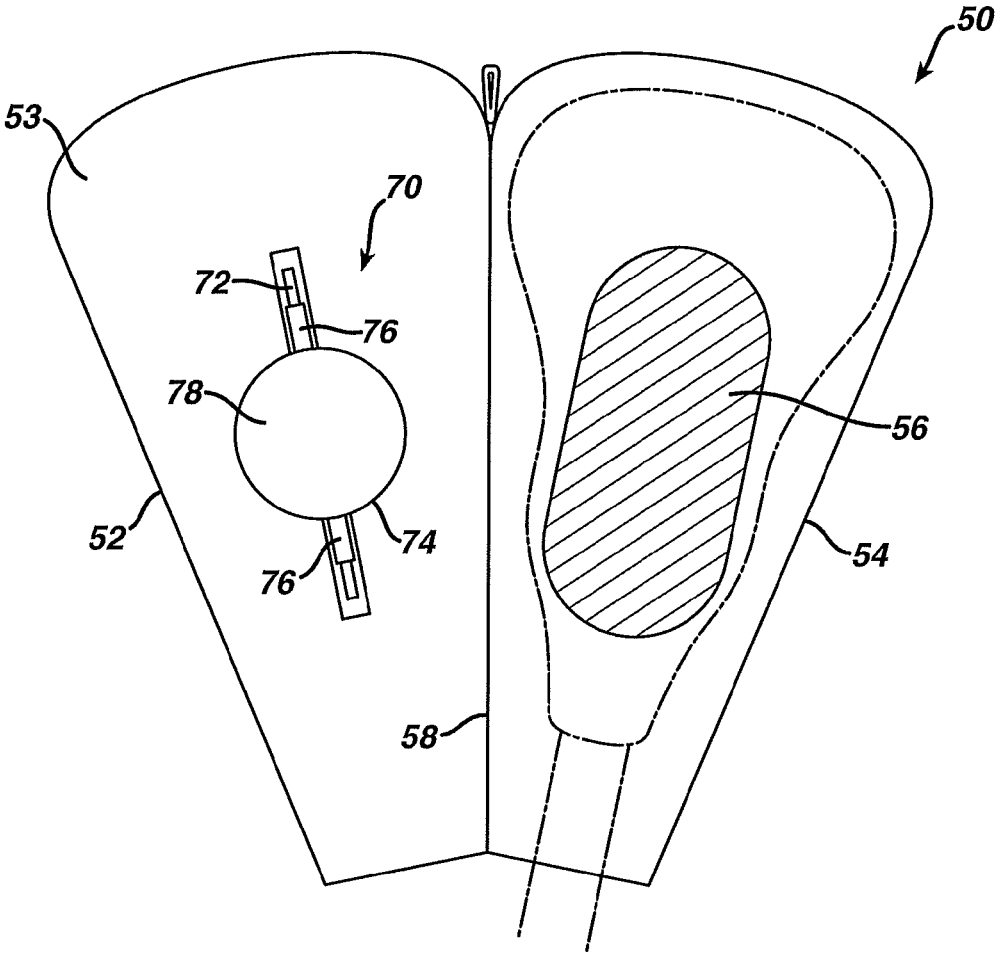
FIG. 3 is a plan view of one embodiment of the invention in an open position with a lacrosse head and shaft shown in phantom.
Figure 4:
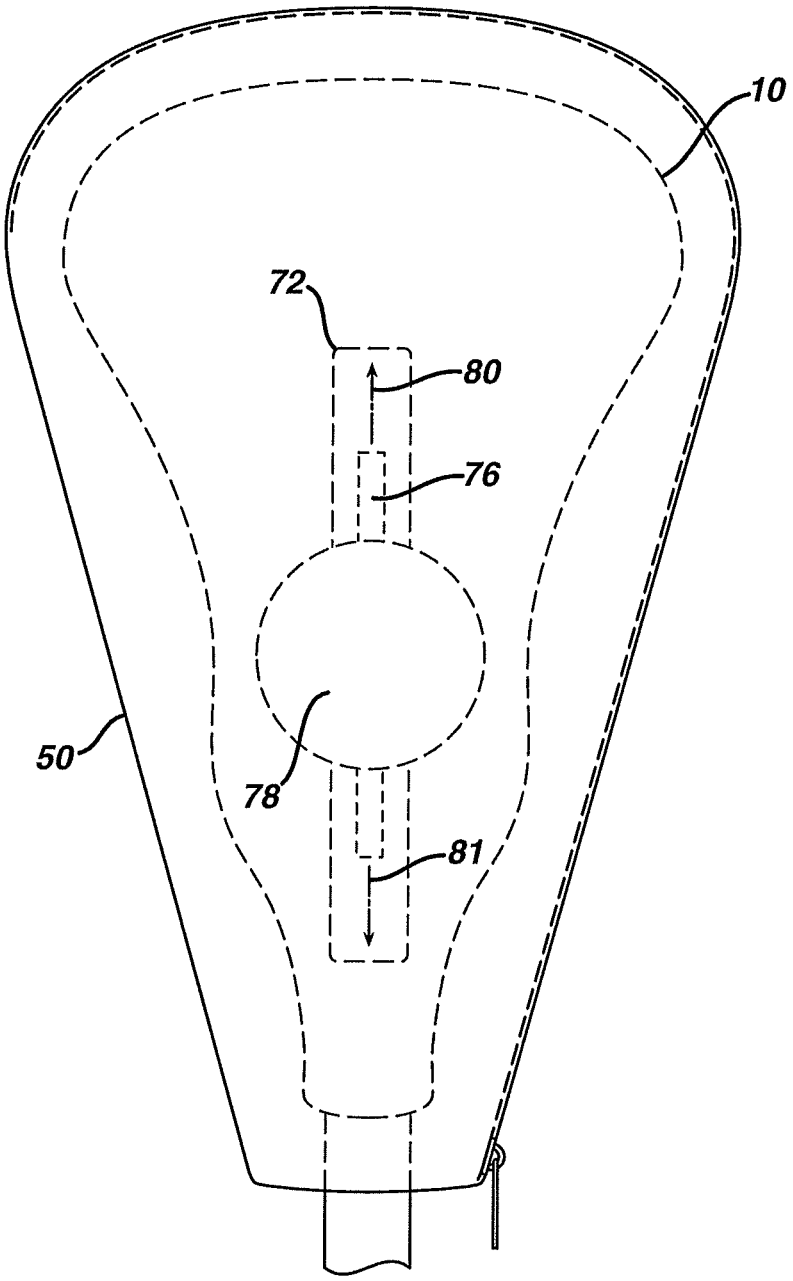
FIG. 4 is a plan view of one embodiment of the invention enclosing a lacrosse head, shown in phantom.
Figure 5:
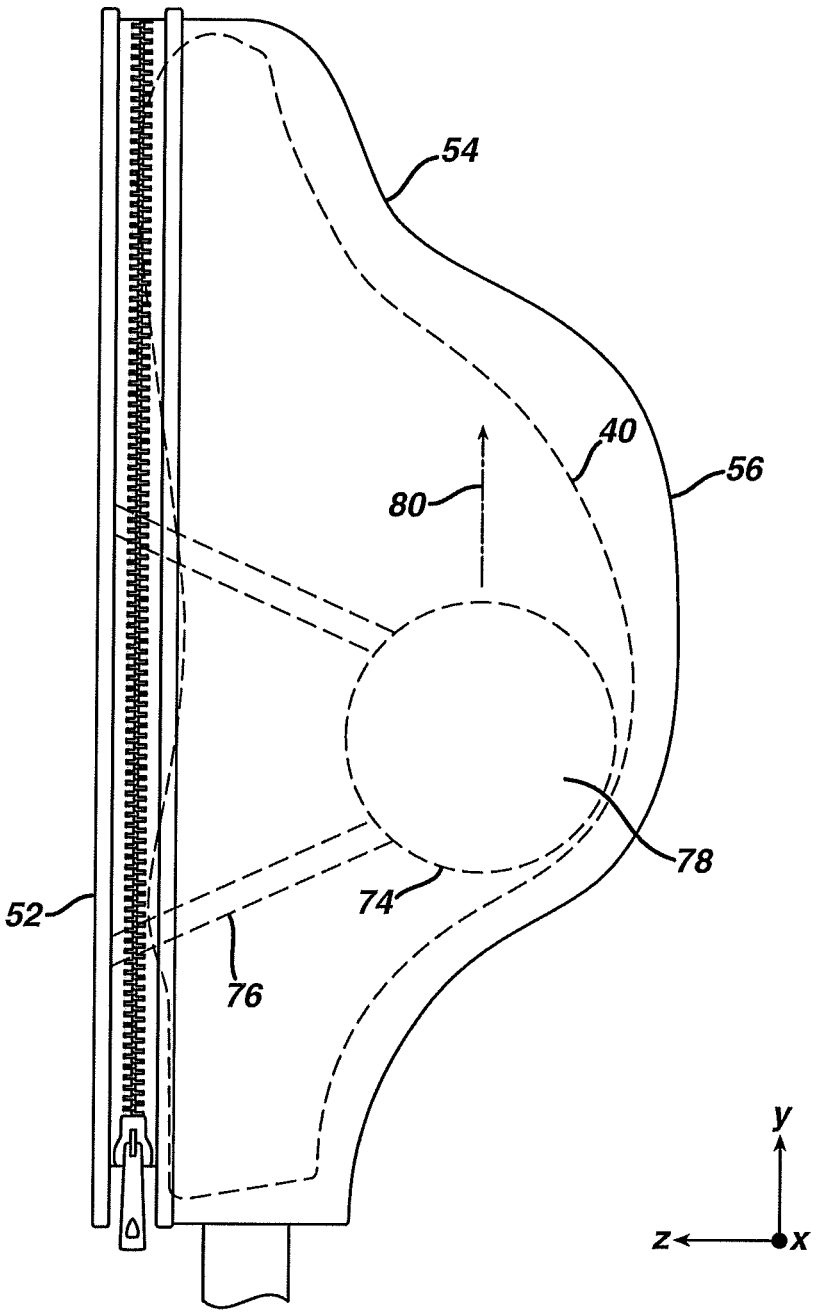
FIG. 5 is a side elevation view of the embodiment of the invention shown in FIG. 4 with a lacrosse head shown in phantom.

Referring now to FIGS. 3-5, shown is a first embodiment of a casing or lacrosse head cover or protector 50 having two opposing panels 52 and 54 for protecting a lacrosse head and shaping and maintaining a lacrosse net pocket by providing a component that will both protect the head and aid in maintaining a desired shape of a lacrosse pocket. The head protector 50 is easily secured over the lacrosse head or the entire lacrosse stick, and a pocket keeper or retainer 70 is integral with the head protector 50, so that the head is protected and the pocket is maintained. The pocket keeper 70 is to form a certain shape or contour of the pocket 40. The lacrosse ball is more easily maneuvered when the pocket 40 maintains the desired shape to cradle the ball. The pocket retainer 70 aids in maintaining the desired shape of the pocket whether the net is wet or dry.

Head cover 50 may be customized with the player's name, team and uniform number, or with a favorite college or pro lacrosse team. Head cover 50 may also be accessorized to include pockets or compartments for storing spare stringing, screws, and the like.

Panel 52 is substantially planar and panel 54 has a bulbous shape or protrusion to form a hollow or chamber 56 to accept a pocket 40 (FIG. 5). Panels 52 and 54 are connected together along a first edge 58 by conventional means such as stitching, gluing, bonding or other known means. The remaining edges of panels 52 and 54 attach or fasten together by means of a zipper, Velcro strips, buttons, magnets or other fasteners commonly known. Panels 52 and 54 are preferably made from a water resistant material, such as plastic, Gore-Tex® or similar material. Panels 52 and 54 are sized to accept a lacrosse head 10 and a portion of the handle. In an alternate expression of the first embodiment, lacrosse head cover may include a tubular-shaped extension to accept the entire handle of the lacrosse stick. Further, panels 52 and 54 may be connected together at alternate edges, at more than one edge or alternatively may have a fastening means around the entire circumference or periphery of each panel. In still an alternate expression, head cover 50 may be bag-shaped and have a large opening for accepting lacrosse head 10 and a closure means, such as strings, elastic, and the like for closing the large opening after placement of lacrosse head 10.

Attached on the inside face 53 of panel 52 is the pocket keeper or retainer system 70, which includes in one embodiment a mounting bracket 72 and a pocket retainer 74. Pocket retainer 74 includes supports 76, which interface with mounting bracket 72 and a pocket retainer element 78 for maintaining the shape of pocket 40. Supports 76 are sized so that ball-shaped element 78 engages pocket 40 when panels 52 and 54 are fastened together (shown illustratively in FIG. 5). Retainer element 78 may be ball-shaped having the dimensions of a lacrosse ball or may have alternate shapes as discussed below. Pocket retainer 74 may be made from any number of materials, such as, rubber, plastic or the like. To reduce weight, retainer element 78 may be hollow and also have cutouts, similar to a wiffle ball. In one expression of the first embodiment, retainer element 78 may comprise a hydrophilic material to help wick moisture away from net 20 when it is wet. In an alternate expression of the first embodiment, supports 76 may be adjustable to adjust the interface depth of retainer element 78.

In still another alternate expression of the first embodiment, supports 76 are moveable along bracket 72 so that retainer element 78 is moveable relative to lacrosse head 10 (e.g. in the y direction of FIG. 1) depending upon the preferred location of pocket 40 by the user (see positions 42*a* and 42*b* of FIG. 2). Supports 76 may slide along bracket 72 and held in place by a set screw or detents or other known means. In an alternate expression, pocket retainer 74 may fasten to the inside face 53 by means of Velcro strips, snaps, clips or other fastening means. Preferably, multiple fastening elements exist so the user may reposition pocket retainer 74 at alternate positions on inside face 53 as shown by arrows 80 and 81 of FIGS. 4 and 5.

Referring to FIG. 5, panel 54 is sized so that it expands to form a hollow 56 to accommodate net 20 and pocket 40 when pocket retainer 74 is positioned within net 20 and pocket 40. In one expression, panel 54 may be made from a flexible material or simply sized to have excess material that conforms to pocket 20, net 40 and pocket retainer 74 when the head cover 50 is in use. In still an alternate expression, panel 54 may be pre-formed in a bulbous-like shape to form a hollow sized to accommodate various positions of net 40 as discussed above. Such a pre-formed hollow may be obtained by integrating a piece of plastic molded in the desired shape of the hollow 56 within the fabric or material of panel 54. Other methods for forming a hollow 56 are left up to those skilled in the art.

Figure 6:
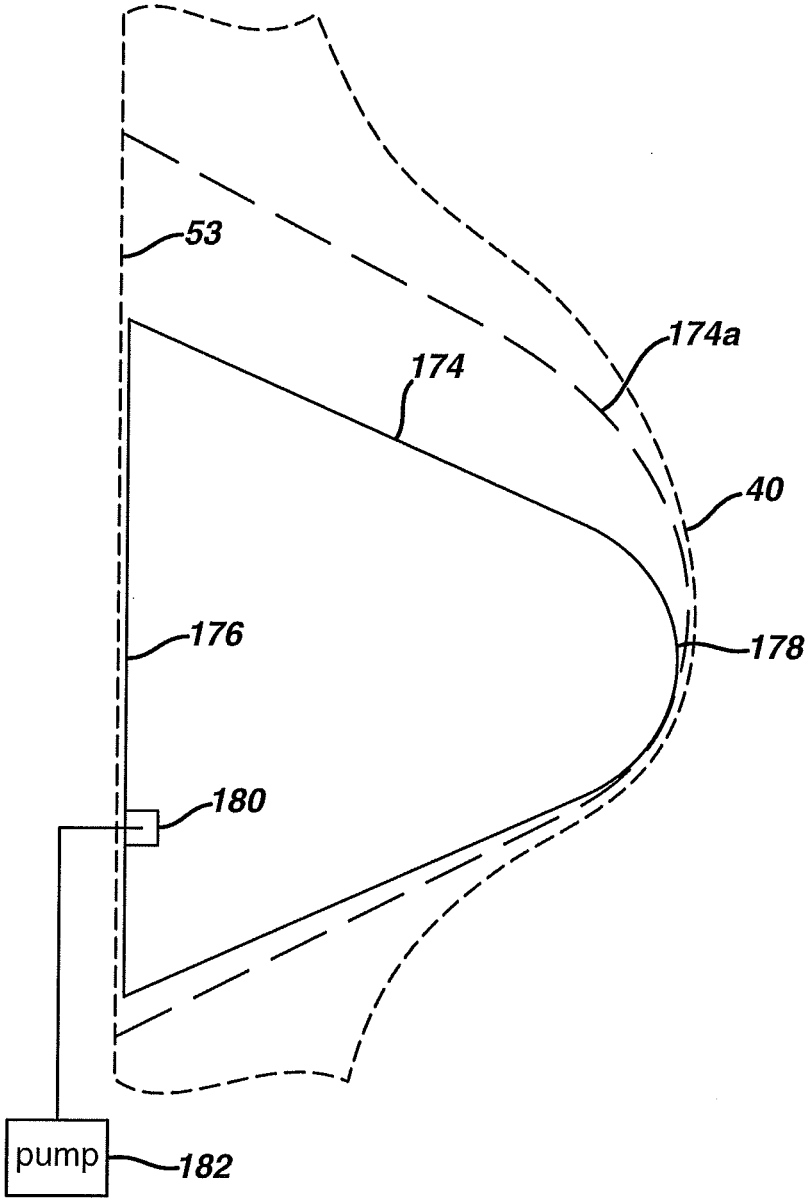
FIG. 6 is an elevation view of an alternate embodiment of one component of the invention.

Referring now to FIG. 6, an alternate expression of a pocket retainer system is shown. FIG. 6 discloses a pocket retainer 174 that combines supports 76 and retainer element 78 into a single structure. Pocket retainer 174 may be made from a moldable material, such as a plastic. Pocket retainer 174 may be solid or hollow, but has a surface 176 that interfaces with inner face 53 by way of a bracket or other fastening means as discussed above and a surface 178 for interfacing with pocket

40. In an alternate expression, pocket retainer 174 may be formed of a pliable material and filled with a fluid or gel to provide shape and support to retain pocket 40. In still an alternate expression, pocket retainer 174 may be a bladder that may be selectively filled with air or other fluids as determined by the user. For example, pocket retainer 174 may have a conventional valve 180 for accepting an air pump needle. The user may selectively inflate pocket retainer 174 with air. Alternatively, a pump 182 may be attached to or integrated into head cover 50 and allow for selective inflation and deflation of pocket retainer 174. Pump 182 may be manual or powered using, batteries, for example.

In still an alternate embodiment of the invention, head cover 50 may be sold with different sizes of a pocket retainer, 174 and 174*a* in a kit form. Each pocket retainer 174 and 174*a* takes on a separate shape or may be inflated to different shapes to allow the user to modify how much surface area of pocket 40 or a particular region of pocket 40 interfaces with a particular pocket retainer 174, 174*a*. This may be convenient for a player that plays more than one position, such as middie and defense.

While the present invention has been illustrated by description of several embodiments, it is not the intention of the applicant to restrict or limit the spirit and scope of the appended claims to such detail. Numerous variations, changes, and substitutions will occur to those skilled in the art without departing from the scope of the invention. For example, obvious variants of the lacrosse head cover 50 exist, such as a sack or casing having an opening for accepting a lacrosse head 10. Positioned within the sack is a pocket retainer system of a form described above.

Moreover, the structure of each element associated with the present invention can be alternatively described as a means for providing the function performed by the element. Accordingly, it is intended that the invention be limited only by the spirit and scope of the appended claims.

We claim:

1. A device in combination with a lacrosse head and a net assembly attached to the lacrosse head, wherein the net assembly defines a concave ball-receiving surface, comprising:

a lacrosse head cover, sized to enclose the lacrosse head, comprising a first surface; and a retaining element attached to the first surface and comprising a convex surface that is coextensive with at least a portion of the concave ball-receiving surface, wherein the retaining element is adjustably attached to the first surface.

2. The device of claim 1, wherein the retaining element is ball-shaped having the substantial dimensions of a lacrosse ball.

3. The device of claim 1, wherein the lacrosse head cover comprises fastening means for securing together first and second portions of the lacrosse head cover.

4. The device of claim 1, wherein the lacrosse head cover further comprises an opening for a lacrosse stick.

5. The device of claim 3, wherein the fastening means is adapted to unfasten the first and second portions for insertion and removal of the lacrosse head.

6. The device of claim 1, wherein the lacrosse head cover further comprises a hollow, sized and shaped to accommodate the concave ball-receiving surface.

7. The device of claim 1, wherein the retaining element is slidably attached to the first surface.

* * * * *